US008122875B2

(12) United States Patent
Kim et al.

(10) Patent No.: US 8,122,875 B2
(45) Date of Patent: Feb. 28, 2012

(54) BURNER ASSEMBLY FOR GAS BURNERS OF RADIANT HEATING TYPE

(75) Inventors: Young Soo Kim, Changwon-si (KR); Dae Hee Jung, Changwon-si (KR); Dae Rae Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1216 days.

(21) Appl. No.: 10/584,893

(22) PCT Filed: Dec. 29, 2003

(86) PCT No.: PCT/KR03/02867

§ 371 (c)(1), (2), (4) Date: Aug. 30, 2007

(87) PCT Pub. No.: WO2005/064235

PCT Pub. Date: Jul. 14, 2005

(65) Prior Publication Data

US 2011/0094504 A1 Apr. 28, 2011

(51) Int. Cl.
*F24C 3/04* (2006.01)

(52) U.S. Cl. ..... 126/92 AC; 126/39 E; 431/354

(58) Field of Classification Search ..... 126/92 AC, 126/39 E, 512; 431/354
See application file for complete search history.

(56) References Cited

U.S. PATENT DOCUMENTS

| | | | | |
|---|---|---|---|---|
| 4,083,355 | A | 4/1978 | Schwank | |
| 4,533,318 | A * | 8/1985 | Buehl | 431/328 |
| 5,439,372 | A * | 8/1995 | Duret et al. | 431/7 |

FOREIGN PATENT DOCUMENTS

| | | |
|---|---|---|
| DE | 4445426 | 6/1996 |
| DE | 19605649 | 8/1997 |
| EP | 0732541 | 9/1996 |
| JP | 8-219422 | 8/1996 |

OTHER PUBLICATIONS

Korean Office Action dated Mar. 28, 2006. (Application No. 10-2004-7019080) (English Translation).

* cited by examiner

*Primary Examiner* — Alfred Basichas
(74) *Attorney, Agent, or Firm* — Ked & Associates LLP

(57) ABSTRACT

A burner assembly for a radiant heating type gas burner is provided. The burner assembly includes a burner chamber that receives a mixed gas, a burner mat on top of the burner chamber for making combustion, and a baffle part between a bottom of the burner mat and a side of the burner chamber. The mixed gas is introduced into the burner chamber through the baffle part for uniform distribution of the mixed gas to an entire part of the burner mat.

19 Claims, 16 Drawing Sheets

BURNER ASSEMBLY FOR GAS BURNERS OF RADIANT HEATING TYPE

TECHNICAL FIELD

The present invention relates to gas burners of radiant heating type, and more particularly, to a burner assembly for gas burners of radiant heating type, in which a burner mat is made to have a non-combusting area for enabling uniform combustion throughout the burner mat even if a flow rate of mixed gas is low.

BACKGROUND ART

The present invention relates to gas burners of radiant heating type, and more particularly, to a burner assembly therefore. In general, the gas burner of radiant heating type is a range in which a heating object is heated with a radiant wave emitted from a radiant body when the radiant body is heated by burning a mixed gas of a fuel and air, to cook food.

FIG. 1 illustrates a related art gas burner of radiant heating type, schematically. That is, the related art gas burner of radiant heating type is provided with an oven part 10, and a top burner part 20.

The top burner part 20 is provided with a burner assembly shown in FIG. 2. The related art burner assembly will be described with reference to FIG. 2.

The related art burner assembly is provided with a burner housing 21, a glass plate 22, a mixing tube 23, a burner chamber 24, and a burner mat 25. The burner housing 21 shapes an outside of the burner assembly, and forms a combustion space. The glass plate 22 is placed on top of the burner housing 21 to close an upper part of the burner assembly.

The mixing tube 23 is a tube in which fuel and air are introduced therein and mixed together, and is in communication with the burner chamber 24. The burner chamber 24 has a closed circumference and an opened top, for receiving the mixed gas from the mixing tube 23, and storing the mixed gas therein. The opened top of the burner chamber 24 is in communication with an inside space of the burner housing 21.

The burner mat 25 is placed on the burner chamber 24, for burning the mixed gas from the burner chamber 24. The burner mat 25 makes surface combustion of the mixed gas, and serves as a radiant body for emitting a radiant wave.

The operation of the burner assembly will be described.

When a user ignites in a state a heating object is placed on the glass plate 22, the fuel and air are introduced into the mixing tube 23, and mixed therein during the fuel and air pass through the mixing tube 23.

Then. the mixed gas is introduced into the burner chamber 24 in communication with the mixing tube 23, passes through the burner mat 25, and blows out into the inside of the combustion space of the burner housing 21. At the same time with this, the mixed gas is ignited with an igniting spark generated by an igniting means (not shown).

The mixed gas burns on a surface of the burner mat 25, and the burner mat 25 emits a radiant wave as the burner mat 25 is heated by the combustion. Then, the radiant wave transmits the glass plate 22, and heats the heating object, to cook food.

However, the related art burner assembly has a problem in that a low temperature heating is difficult in a case the burner assembly is a relatively large size application, for example, not for heating of a small kettle, but for heating of a large cooking object.

That is, in a case the gas supply is reduced for low temperature heating, to cause an extreme shortage of the mixed gas supplied to the burner chamber 24 compared to an area of the burner mat 25, the combustion takes place only in a central part of the burner mat 25 the mixed gas supply thereto is smooth, but not in an outer part of the burner mat 25.

Thus, if the combustion takes place only in the central part of the burner mat 25, but not in the outer part of the burner mat 25, the large cooking object will be heated at the central part, but not throughout the large cooking object, uniformly.

Moreover, when the combustion takes place only at the central part of the burner mat 25 locally, the flame can be extinguished, easily. This is because, taking a substantially large surface area of the burner mat 25 into account, the flame at the central part of the burner mat 25 can not spread to the outer part of the burner mat 25 smoothly due to shortage of the mixed gas. In this case, the gas keeps flow out even if there is no combustion, to cause fire hazard.

DISCLOSURE OF INVENTION

An object of the present invention designed to solve the foregoing problems lies on providing a burner assembly which enables smooth combustion at an outer part of a burner mat too, even if supply of mixed gas is small.

The object of the present invention can be achieved by providing a burner assembly for a gas burner of radiant heating type including a burner chamber for receiving mixed gas, a burner mat on a top of the burner chamber having a combusting area, and at least one non-combusting area, and a combustion cutoff part for forming the non-combusting area of the burner mat.

The combustion cutoff part includes a structure for forming the non-combusting area between a center and an outer part of the burner mat, or at a center part of the burner mat, including a cutoff plate in close contact with an upper surface or a lower surface of the burner mat for preventing the mixed gas from reaching to a surface of the burner mat, and burning, and a supporting part for supporting the cutoff plate.

In other aspect of the present invention, there is provided a burner assembly for a gas burner of radiant heating type including a burner chamber for receiving mixed gas, and a burner mat part on top of the burner chamber, including an inner burner mat and an outer burner mat each having a combusting area, and a separated part between the inner burner mat and the outer burner mat having a non-combusting area.

The separated part between respective burner mats includes a cutoff plate in close contact with a circumference of an upper surface of each of the burner mats, and a supporting part connected to the cutoff plate having seating steps for seating the circumference of each of the burner mats.

In another aspect of the present invention, there is provided a burner assembly for a gas burner of radiant heating type including a burner chamber for receiving mixed gas, and a burner mat on top of the burner chamber having a combusting area for making combustion, and at least one non-combusting area for making no combustion.

The non-combusting area of the burner mat is formed of a material that permits no surface combustion different from the combusting area.

Thus, the burner assembly of the present invention can make stable combustion only with a low flow rate of mixed gas to improve a combusting efficiency, while a heating performance is not dropped, by forming an overall size of the burner mat large adequately, while a part the mixed gas is supplied thereto and burned is formed smaller.

BRIEF DESCRIPTION OF DRAWINGS

The accompanying drawings, which are included to provide a further understanding of the invention, illustrate embodiment(s) of the invention and together with the description serve to explain the principle of the invention.

In the drawings.

BEST MODE FOR CARRYING OUT THE INVENTION

Figure 1:
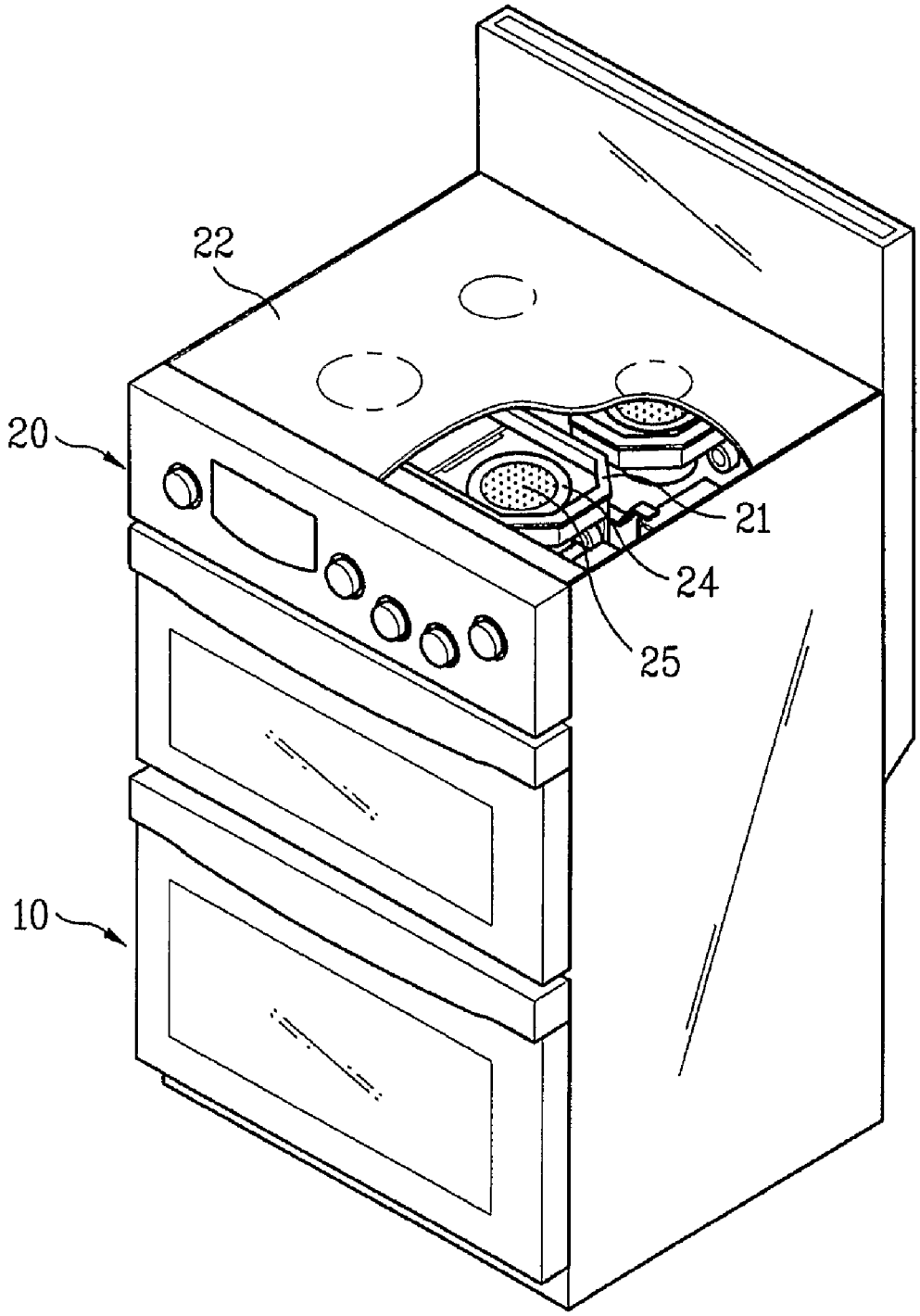
FIG. 1 Prior Art
FIG. 1 illustrates a perspective view of an outside appearance of a related art gas burner of radiant heating type.
Figure 2:
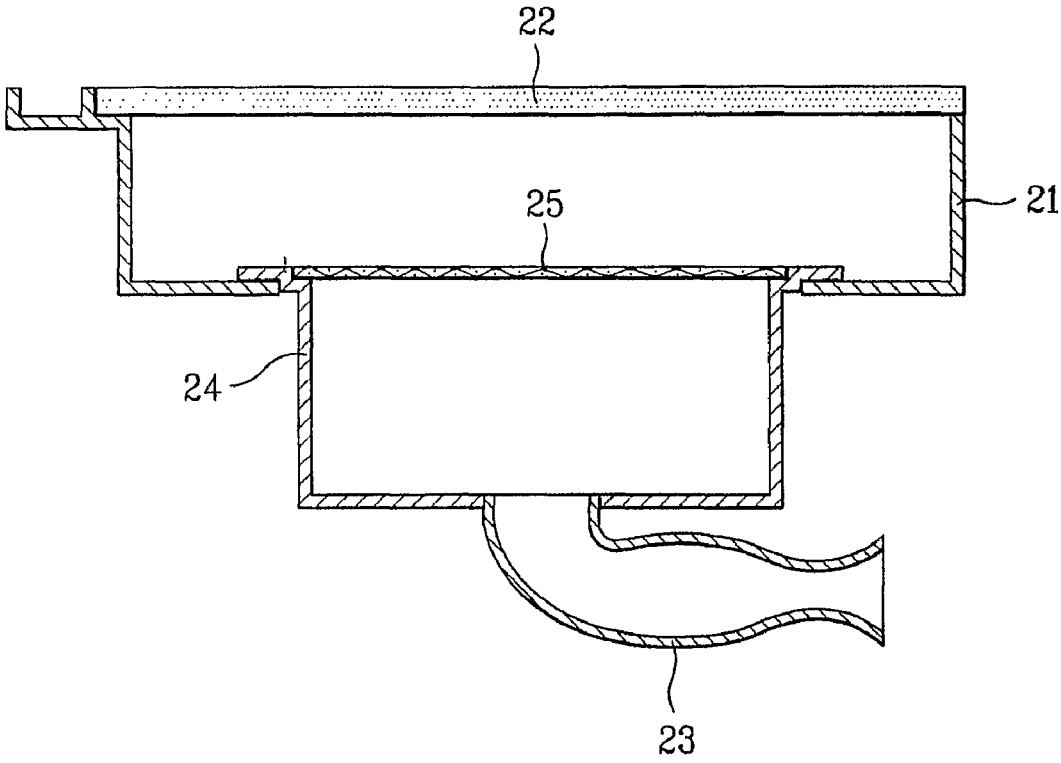
FIG. 2 Prior Art
FIG. 2 illustrates a section showing key parts of a related art burner assembly for a gas burner of radiant heating type, schematically.
Figure 3:
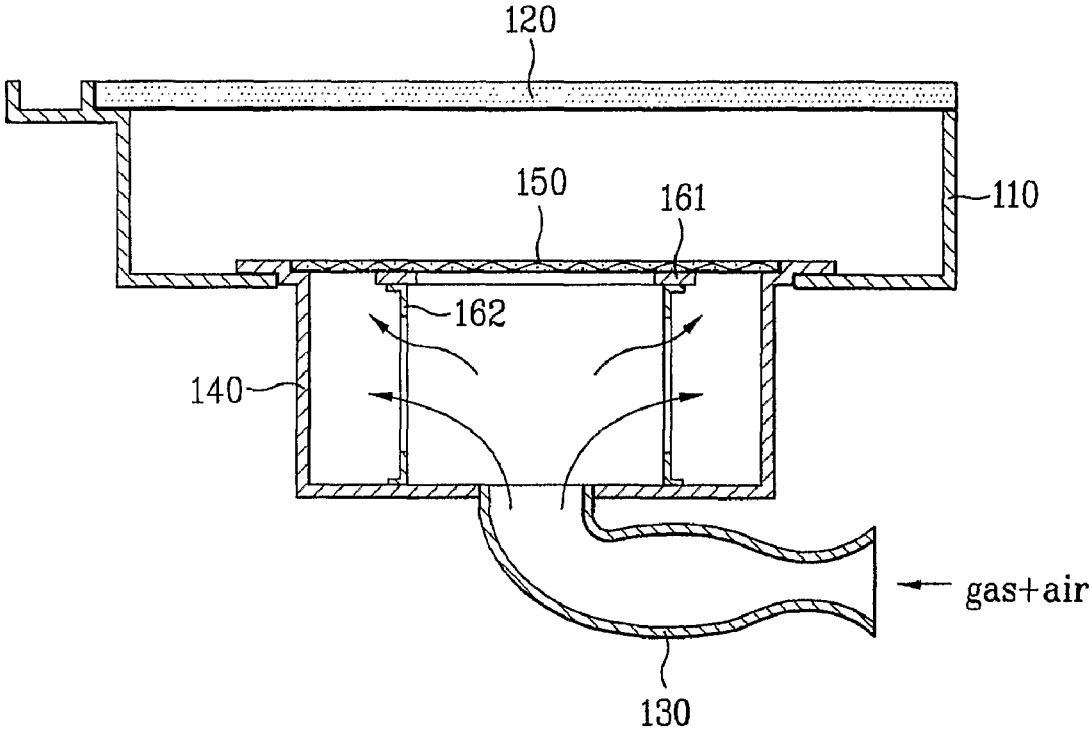
FIG. 3 illustrates a section showing key parts of a burner assembly for a gas burner of radiant heating type in accordance with a preferred embodiment of the present invention, schematically.

Reference will now be made in detail to the preferred embodiments of the present invention, examples of which are illustrated in the accompanying drawings.

The burner assembly in accordance with a first preferred embodiment of the present invention includes a burner chamber 140, a burner mat 150, and a combustion cutoff part. The burner chamber 140 is mounted on an underside of the burner housing 110 for receiving a mixed gas mixed at the mixing tube 130. The burner chamber 140 has an opened top. The burner chamber 140 may have a shape the same with the related art as shown in the drawing, or modified similar thereto.

The burner mat 150 is placed on top of the burner chamber 140, and has a combusting area, and at least one non-combusting area. The non-combusting area is an area fabricated to burn gas, but made unable to make the surface combustion by means of other structure.

The combustion cutoff part forms the non-combusting area at the burner mat 150. The combustion cutoff part includes a cutoff plate 161 for forming the non-combusting area between a center and an edge of the burner mat 150.

The cutoff plate 161 is brought into close contact with at least one of upper surface and lower surface of the burner mat 150, for preventing the mixed gas from reaching to a surface of the burner mat 150. Particularly, it is preferable that the cutoff plate 161 has a ring form substantially when seen in a plan view.

Figure 4A:
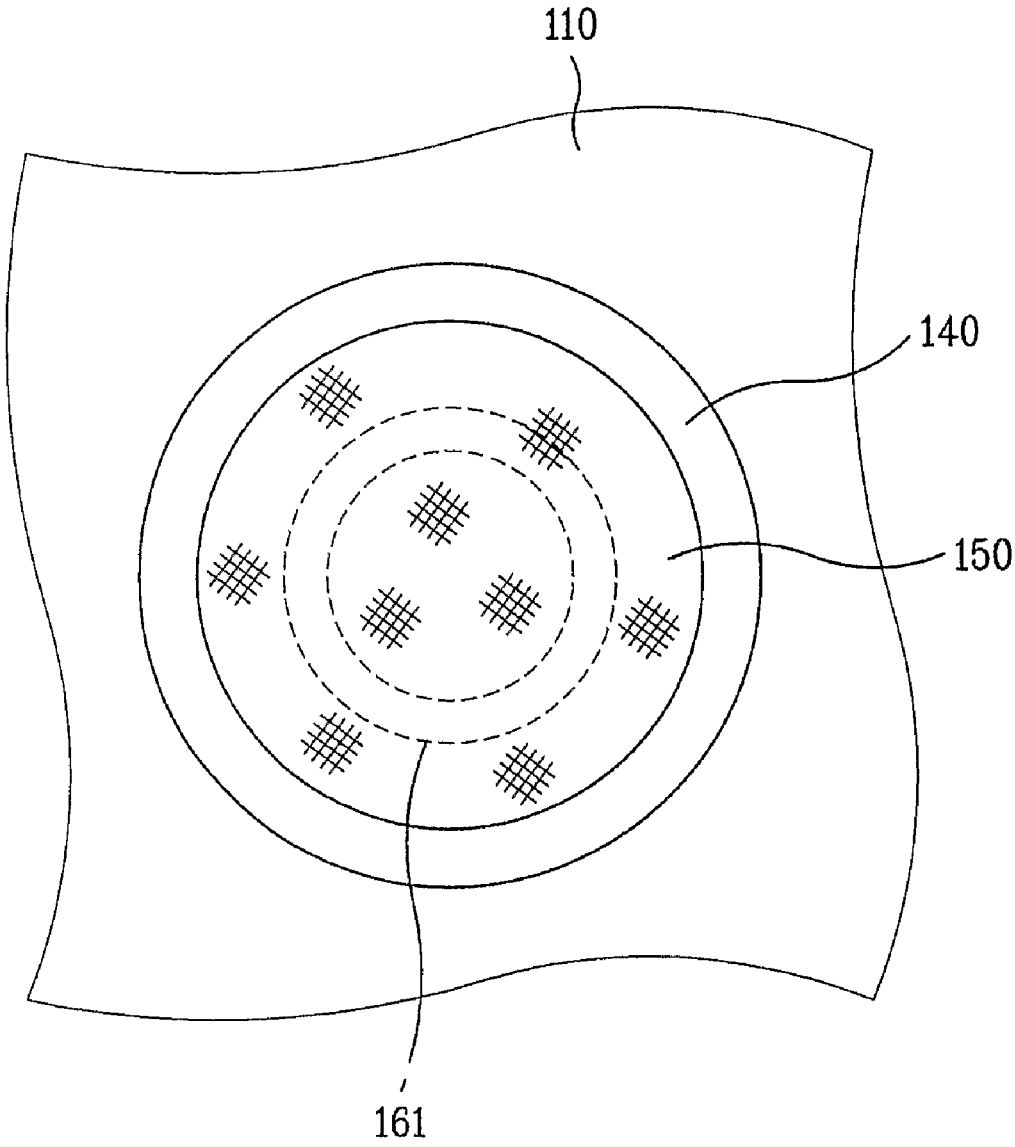
FIGS. 4A~4D illustrate plan views each showing an example of a form of a cutoff plate, and a fitting state of the cutoff plate to a burner mat in accordance with a first preferred embodiment of the present invention.
Figure 4B:
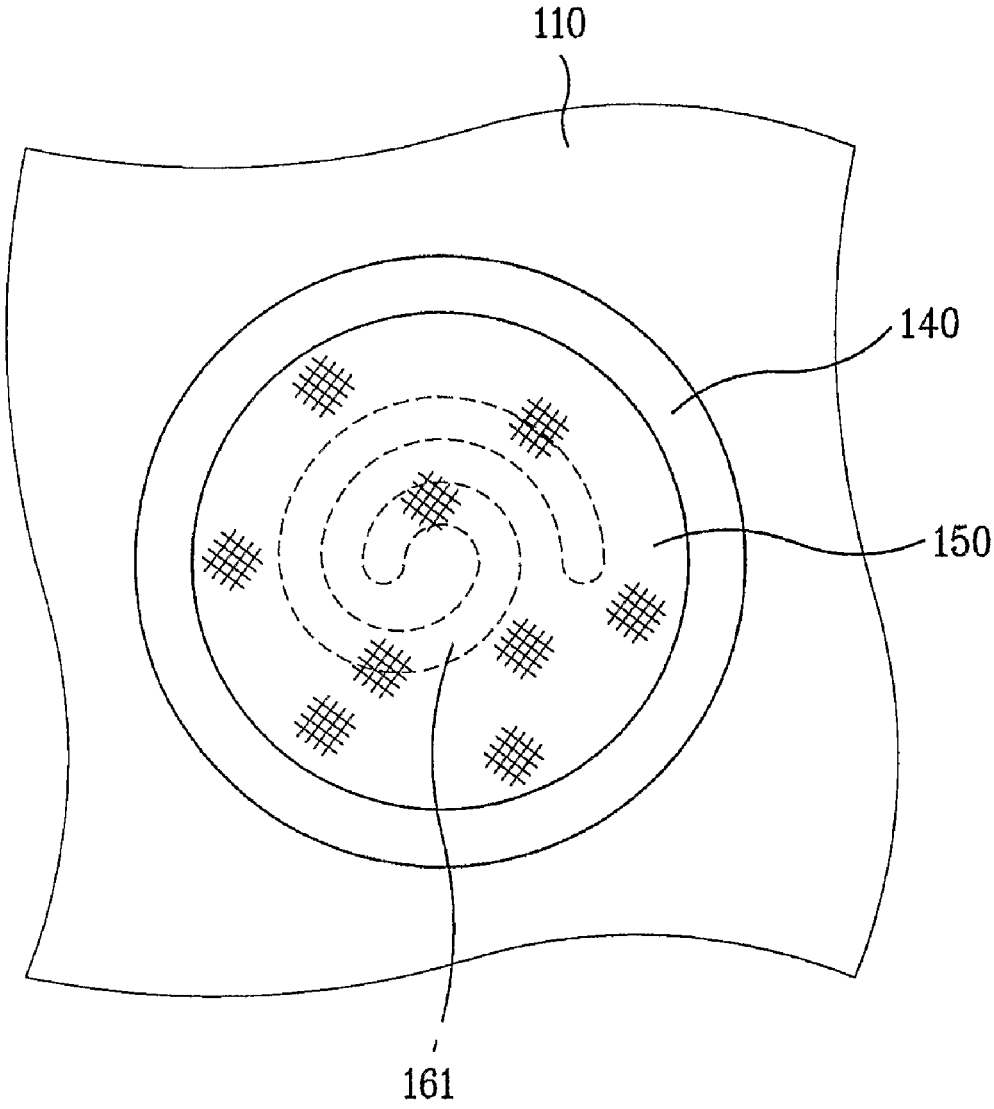
Figure 4C:
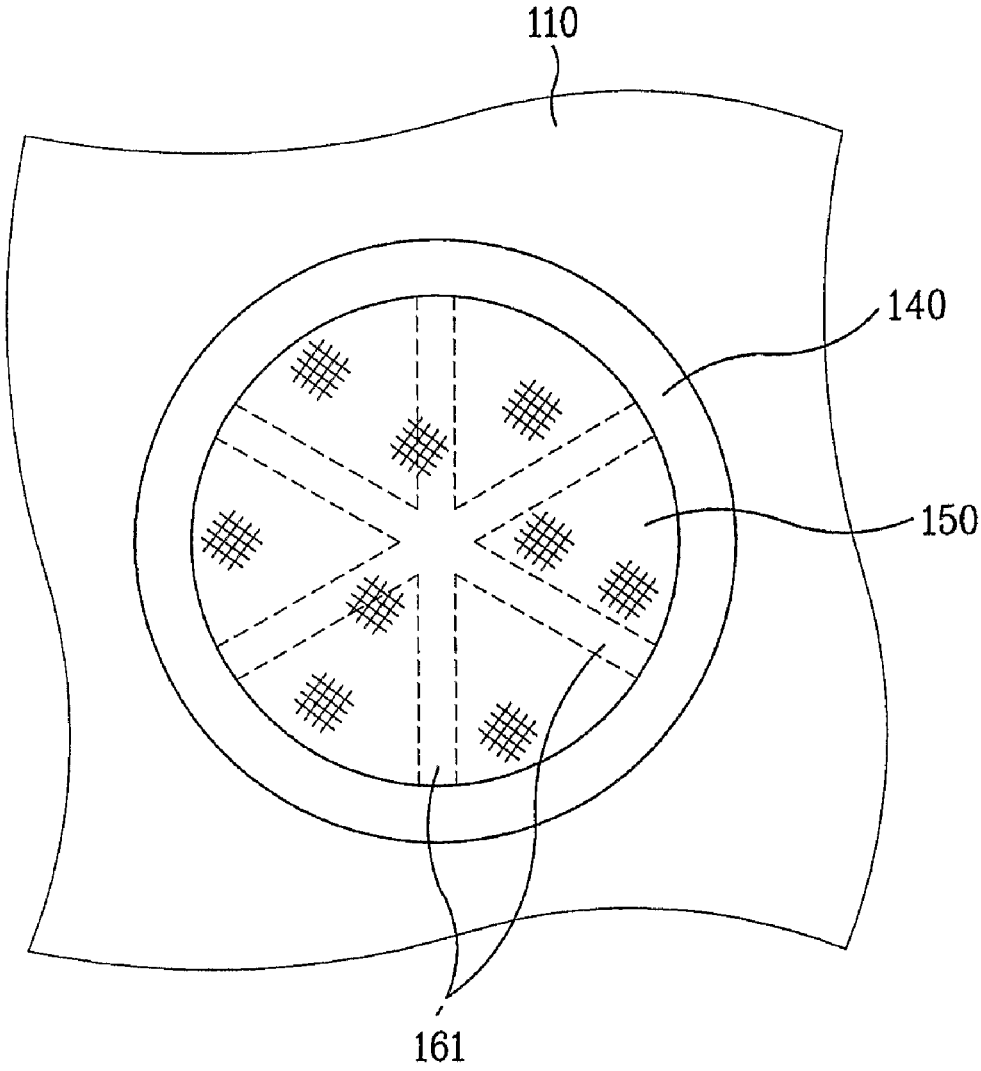
Figure 4D:
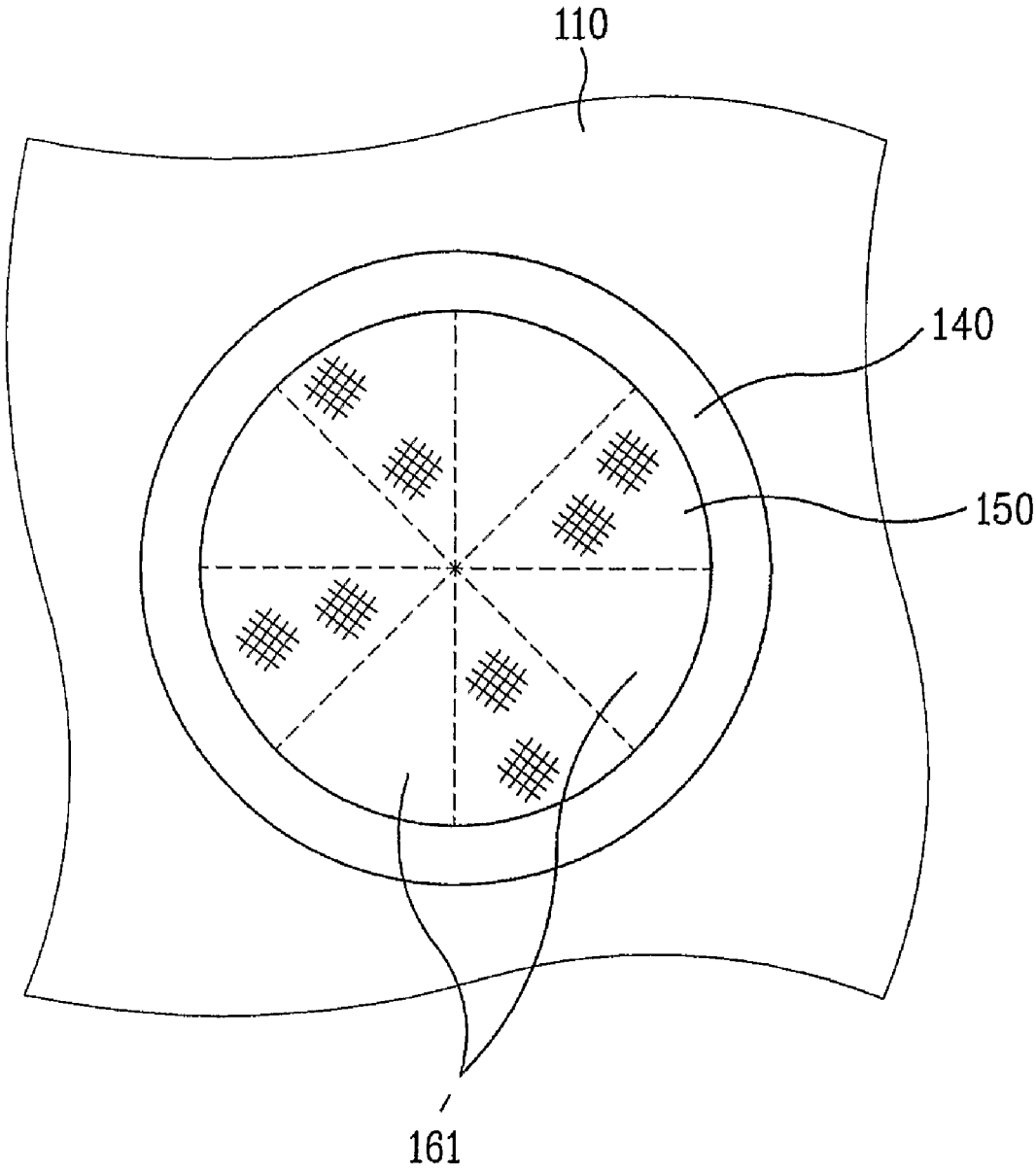

The ring form may be circular as shown in FIG. 4A, or, though not shown, polygonal, such as square, pentagonal, hexagonal and the like. The cutoff plate 161 may not be a ring form, but spiral as shown in FIG. 4B, radial extensions as shown in FIG. 4C, or has a form that becomes the wider (or narrower) as it goes to an edge from the center of the burner mat 150.

It is preferable that the cutoff plate 161 can maintain a state in which the cutoff plate 161 is in close contact with a surface of the burner mat 150, for which the combustion cutoff part in accordance with the preferred embodiment of the present invention further includes a supporting part 162.

The supporting plate 162 supports the cutoff plate 161 such that the cutoff plate 161 is maintained the state in which the cutoff plate 161 is in close contact with the burner mat 150. As shown, in the case the cutoff plate 161 has a structure in which the cutoff plate 161, is in close contact with the lower surface of the burner mat 150, the supporting part 162 has one end fixed to an inside bottom of the burner chamber 140, and the other end supporting a lower surface of the cutoff plate 161.

Figure 5:
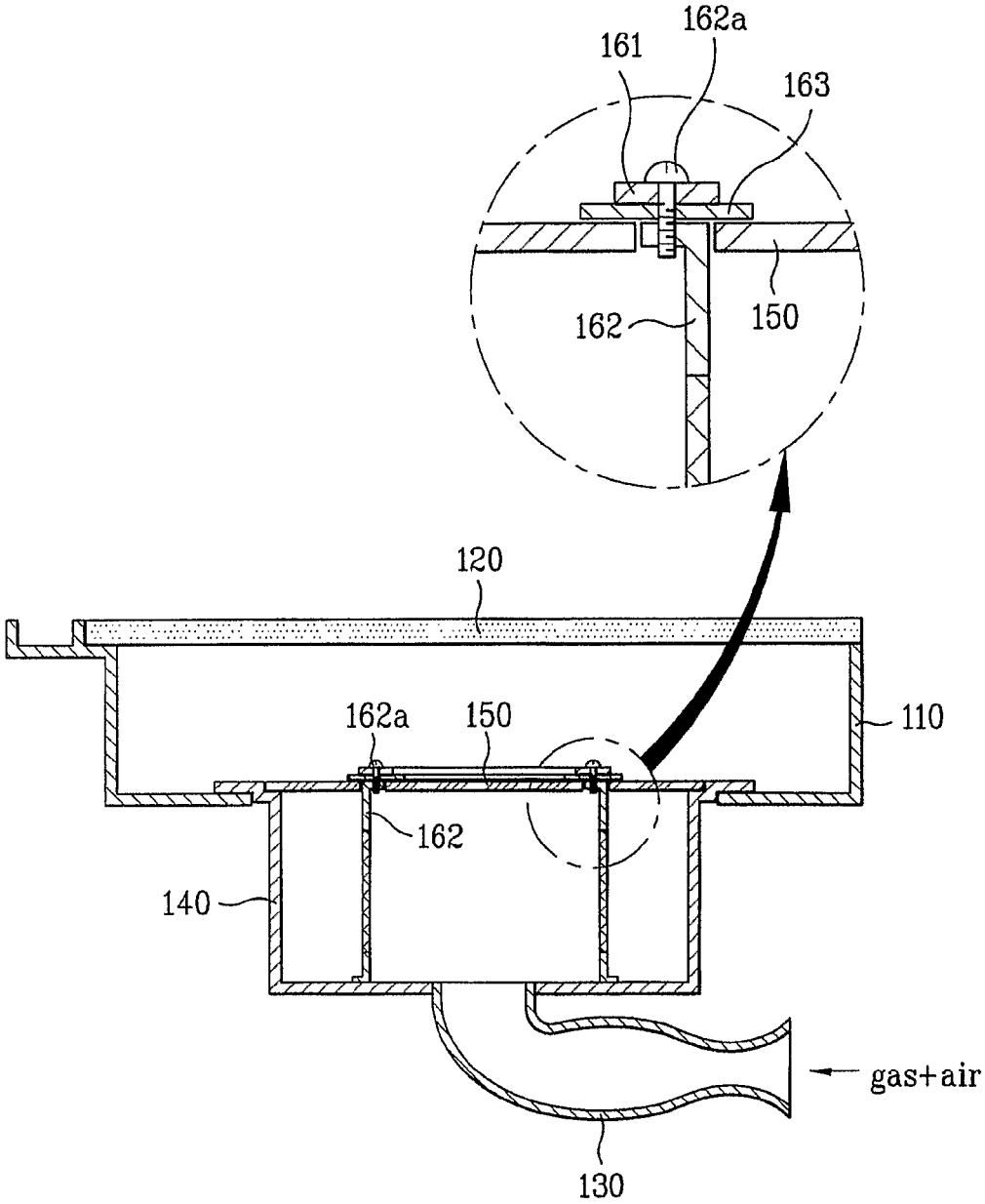
FIG. 5 illustrates a section showing an example of a cutoff plate in accordance with a first preferred embodiment of the present invention fitted to a bottom of a burner mat closely.

Referring to FIG. 5, if the cutoff plate 161 has a structure in which the cutoff plate 161 is in close contact with the upper surface of the burner mat 150, the supporting part 162 has one end fixed to an inside bottom of the burner chamber 140, and the other end passed through the burner mat 150 and connected to the cutoff plate 161.

Figure 6:
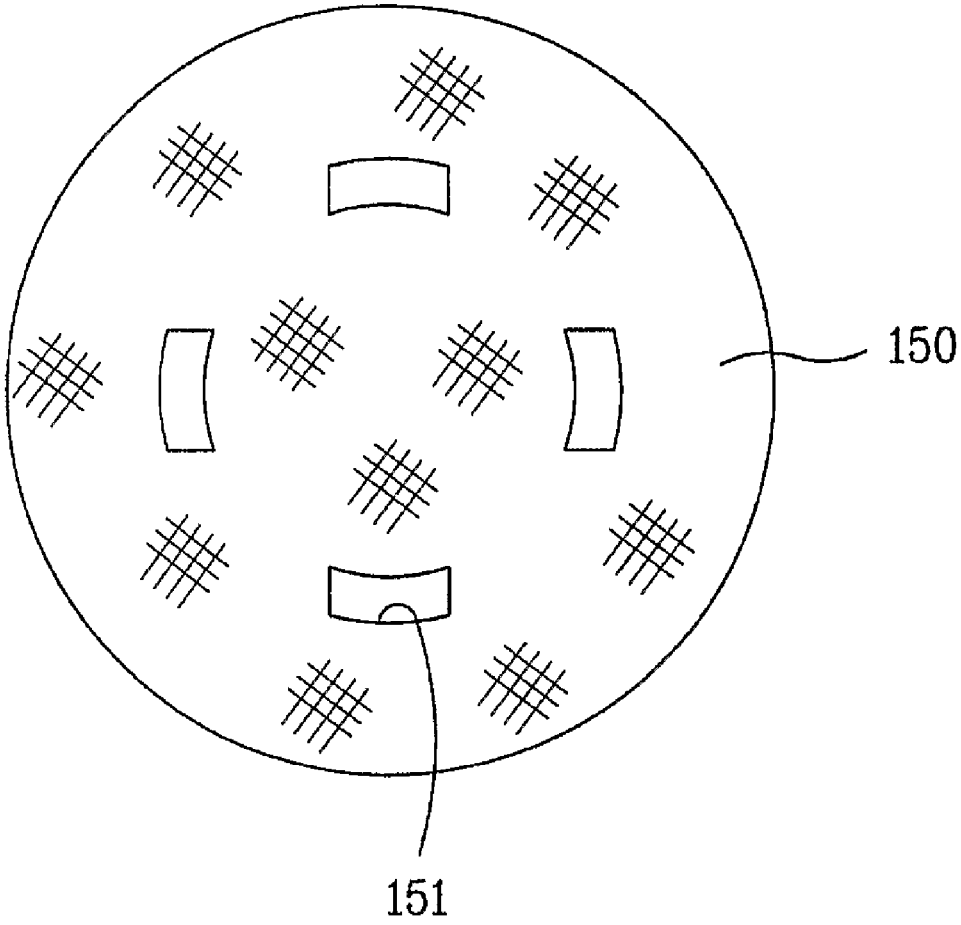
FIG. 6 illustrates a plan view of a burner mat in accordance with a first preferred embodiment of the present invention.

Though the part of the burner mat 150 having the other end of the supporting part 162 passed therethrough may has a form of a ring the same with the cutoff plate 161, which divides the burner mat 150 into two parts, as shown in FIG. 6, it is more preferable that a plurality of through holes 151 are formed in parts of the burner mat 150 for passing the supporting part.

Moreover, it is preferable that the other end of the supporting part 162 is fastened to the cutoff plate 161 with screws 162*a*, for smooth fitting. However, the other end of the supporting part 162 may be joined with the cutoff plate 161 by welding of other joining structure.

Furthermore, in a case of above structure, there is a problem in that gas can be leaked through a connection part between the other end of the supporting part 162 and the cutoff plate 161.

Accordingly, as shown, it is more preferable that a sealing member 163 is provided between a connection part of the supporting part 162 and the cutoff plate 161, for preventing leaking of the mixed gas from the burner chamber 140. It is preferable that the sealing member 163 is formed of a non-combustible material.

Moreover, it is preferable that the cutoff plate 161 is greater than opened parts having the supporting part 162 of the burner mat 150 passed there through, and the sealing member 163 is greater than the cutoff plate 161.

Figure 7:
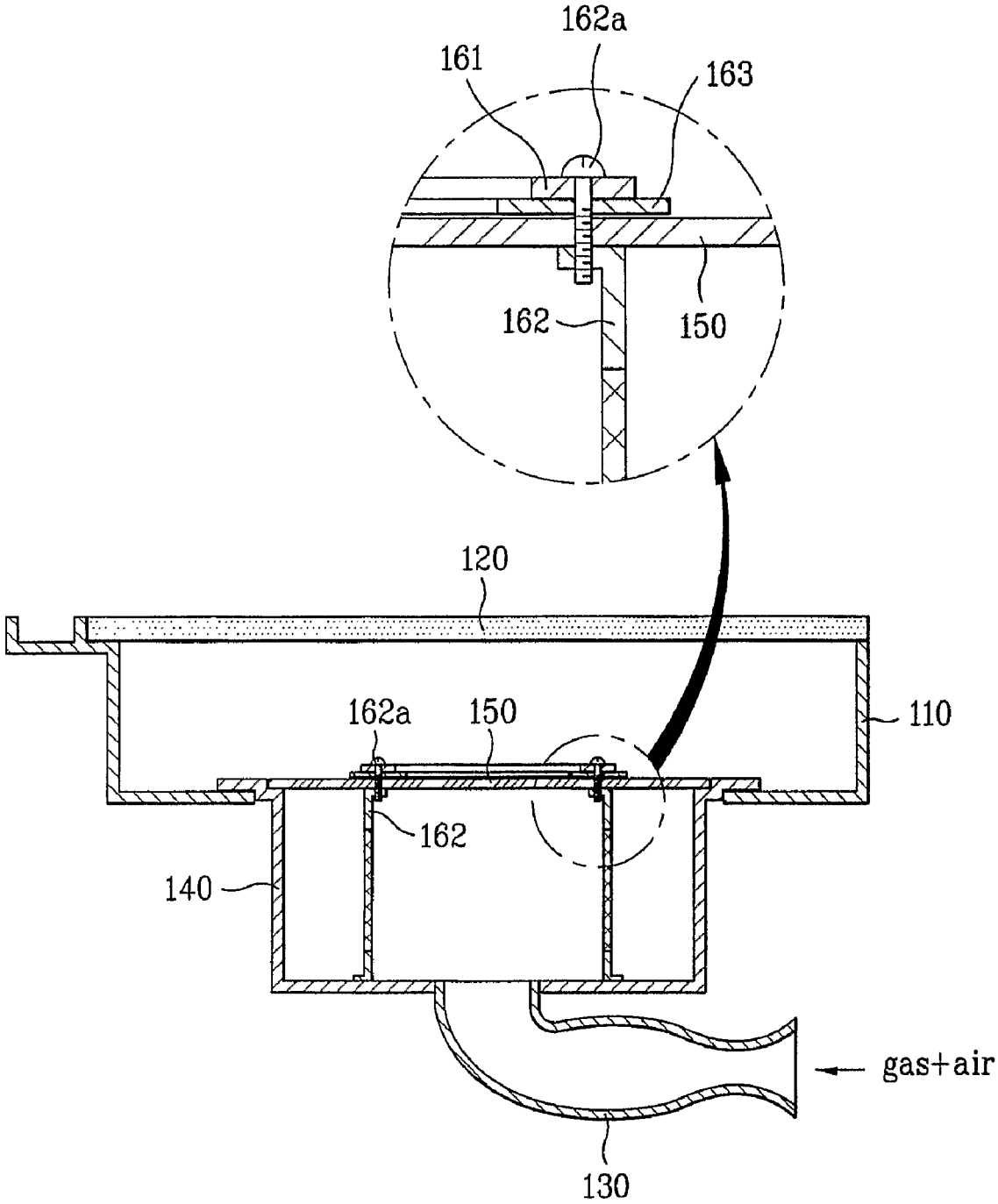
FIG. 7 illustrates a section showing another example of a cutoff plate in accordance with a first preferred embodiment of the present invention fitted to a bottom of a burner mat closely.

Of course, as described before, if the cutoff plate 161 has a structure in which the cutoff plate 161 is in close contact with the upper surface of the burner mat 150, the supporting part 162 may not pass through the burner mat 150 as shown in FIG. 7.

In this case too, it is preferable that the sealing member 163 is provided between the cutoff plate 161 and the upper surface of the burner mat 150, and it is preferable that the cutoff plate 161 is fastened to the supporting part 162 with screws 162*a*.

Moreover, it is preferable that, by providing openings in a side surface (circumferential surface) of the supporting part 162, the mixed gas flows from the burner chamber 140 to the outer side of the burner mat 150, smoothly. Particularly, it is more preferable that, by providing the supporting part 162 of mesh form, the mixed gas spreads more smoothly.

For an example, if the supporting part 162 is of a cylindrical mesh form, with a bottom part thereof in communication with the mixing tube 130, since the mixed gas introduced into the burner chamber 140 from the mixing tube 130 can spread to an outer side space inside of the burner chamber 140 in a process the mixed gas passes through the supporting part 162, concentration of the combustion only to the central part of the burner mat 150 can be prevented. Of course, as shown, it is more preferable that only a part of side of the supporting part 162 is of the mesh form for solving a problem of strength.

A burning process of the burner assembly having the system of the first preferred embodiment of the present invention applied thereto will be described.

When the user ignites, gas and air are introduced into the mixing tube 130, and mixed during the gas and the air pass through the mixing tube 130. The mixed gas is introduced into the burner chamber 140 that is in communication with the mixing tube 130, and blows out into the combustion space of the burner housing 110 through the burner mat 150. At the same time with this, the mixed gas is ignited by an igniting spark generated with igniting means (not shown).

In this instance, the mixed gas can not reach to a part of a surface of the burner mat 150 to which the cutoff plate 161 is in close contact thereto. Consequently, the mixed gas flows toward a neighborhood of the part to which the cutoff plate 161 is in close contact thereto. Since a mixed gas flow toward the central part of the burner mat 150 is smooth, the mixed gas flows toward the neighborhood and flows toward the outer side part of the burner mat 150. Especially, the supporting part 162, supporting the cutoff plate 161, serves to guide the gas to flow toward the outer side of the burner mat 150 additionally, which permits a uniform surface combustion throughout entire part of the burner mat 150.

Of course, the non-combusting area of the burner mat 150, in which no combustion is made to take place by the cutoff plate 161, is heated to a high temperature, even though there is no actual combustion of the mixed gas taken place thereon, because the heat of combustion at the central part and the outer side of the burner mat 150 circulates therethrough.

The radiant wave from the surface combustion of the burner mat 150 transmits the glass plate 120, and heats the heating object, to heat even a large cooking container uniformly throughout an entire part thereof.

Figure 8:
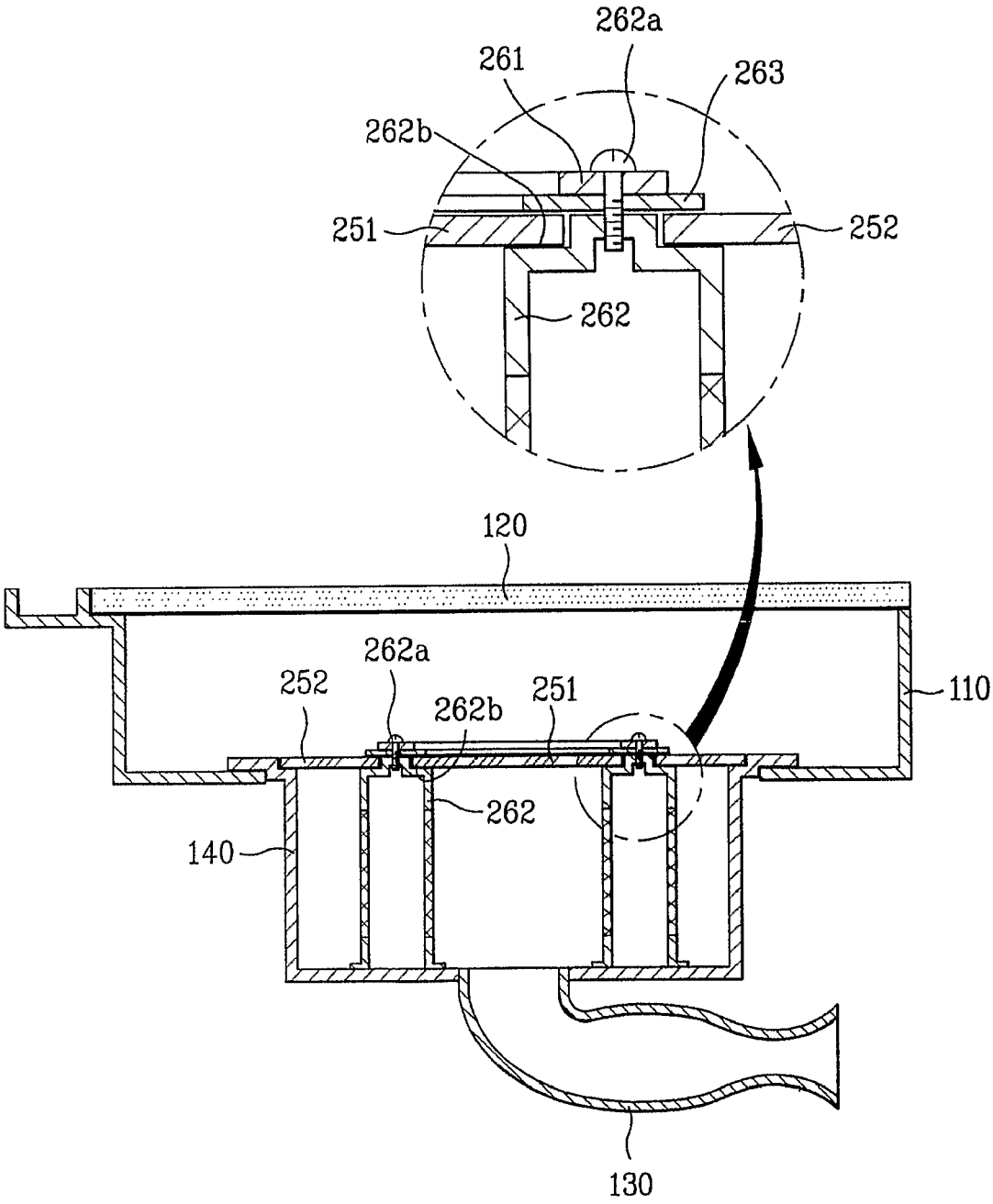
FIG. 8 illustrates a section of a burner assembly in accordance with a second preferred embodiment of the present invention, schematically.

FIG. 8 illustrates a section of a burner assembly in accordance with a second preferred embodiment of the present invention, schematically.

Referring to FIG. 8, the burner assembly is suggested to have an inner burner mat 251 and an outer burner mat 252, separate from each other. A separated part between the inner burner mat 251 and the outer burner mat 252 forms a non-combusting area, while the inner and outer burner mats form combusting area.

It is preferable that a combustion cutoff part is provided in the separated part between the inner burner mat 251 and the outer burner mat 252. The combustion cutoff part serves to support the burner mats 251 and 252 stably, and forms the non-combusting area.

For this, the combustion cutoff part includes a cutoff plate 261 in close contact with a circumference of an upper surface of each of the burner mats 251 and 252, and a supporting part 262 connected to the cutoff plate 261, having seating steps 262*b* for seating a circumference of each of the burner mats 251 and 252.

It is preferable that the cutoff plate 261 is fasted to the supporting part 262 with screws 262*a*, and it is more preferable that a sealing member 263 is provided between the cutoff plate 261 and the supporting part 262, for preventing leakage of the mixed gas from the burner chamber 140.

Figure 9:
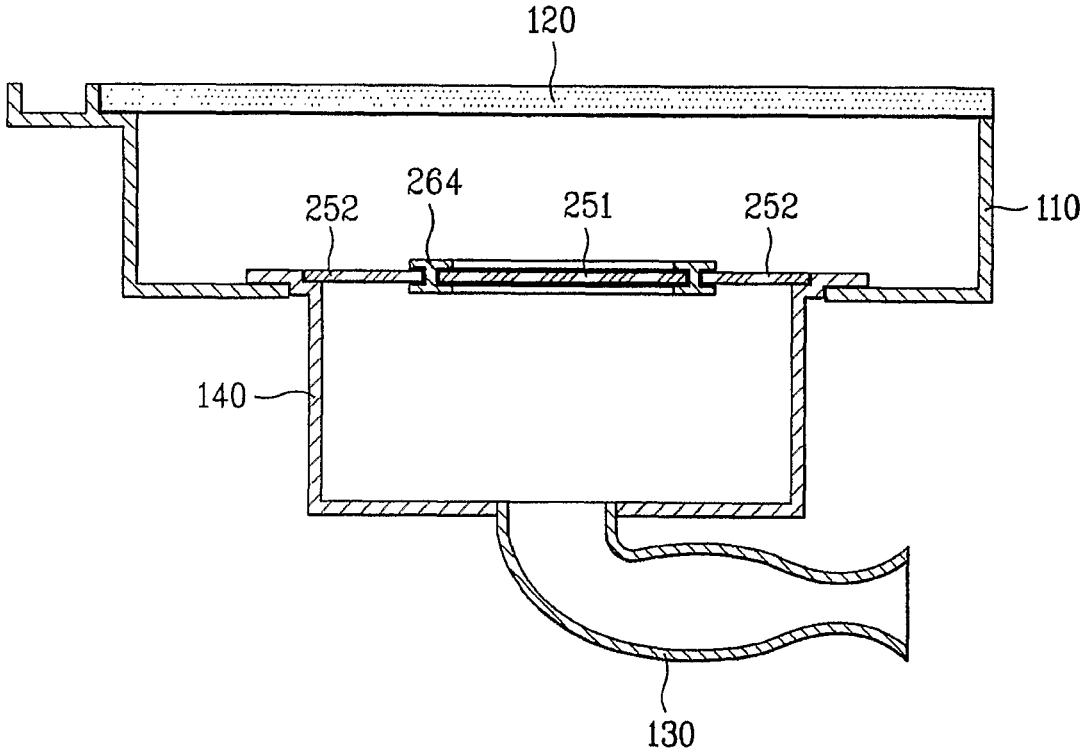
FIG. 9 illustrates a section of a variation of a burner assembly in accordance with a second preferred embodiment of the present invention, schematically.

FIG. 9 illustrates a section of a variation of a burner assembly in accordance with a second preferred embodiment of the present invention, schematically.

The variation of a burner assembly in accordance with a second preferred embodiment of the present invention includes an inner burner mat 251 and an outer burner mat 252, and a connecting member 264 for connecting the inner mat 251 and the outer mat 252. The connecting member 264 connects the separated burner mats 251 and 252, as well as surrounds connected parts of the burner mats 251 and 252. Especially, opposite edges of the connecting member 264 are recess for receiving the connected parts of the burner mats 251 and 252.

The connecting member 264, not only permits stable supporting of the separated burner mats 251 and 252, but also forms the non-combusting area by cutting off the mixed gas supply to the part, without any additional cutoff plate 261 or the supporting part 261.

The operation of the burner assembly in accordance with the second embodiment of the present invention is the same with the operation of the first embodiment of the present invention. That is, while no combustion takes place in the separated part between the burner mats 251 and 252, stable combustion takes place not only on the inner burner mat 251, but also on the outer burner mat 252 owing to the smooth flow of the mixed gas to neighborhood of the part the cutoff plate 261 or the connecting member 264 is provided thereto, permitting to heat even a comparatively large cooking container throughout entire surface.

Figure 10:
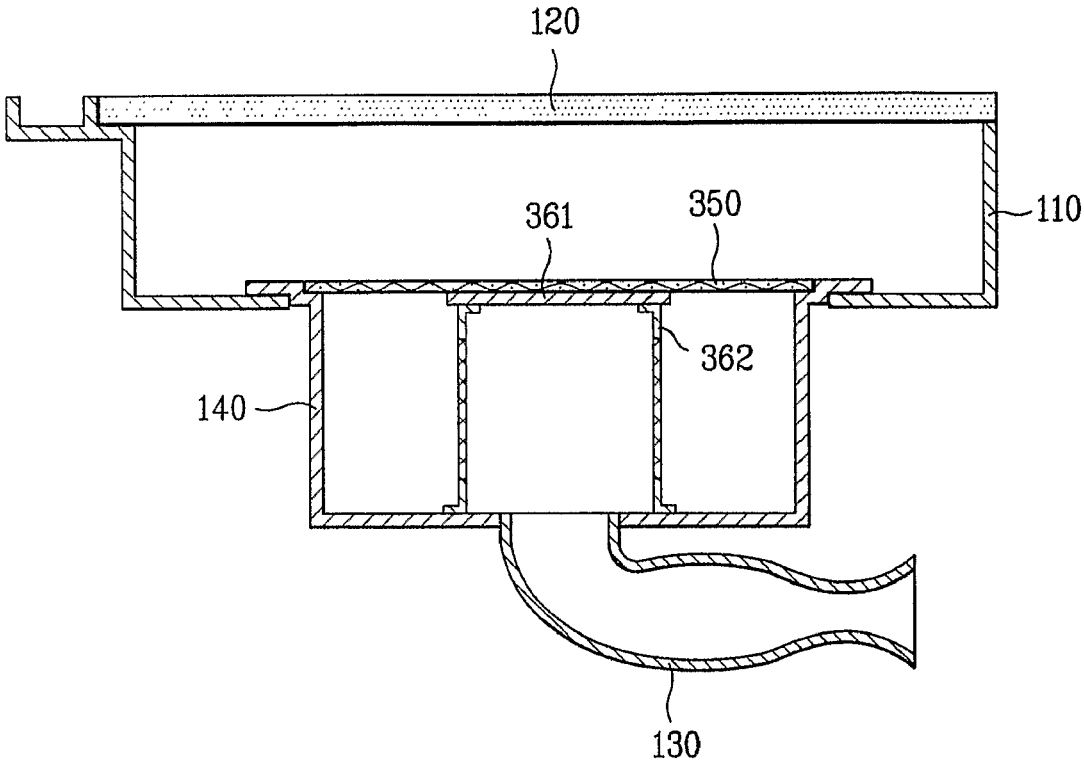
FIG. 10 illustrates a section of a burner assembly in accordance with a third preferred embodiment of the present invention, schematically.

FIG. 10 illustrates a section of a burner assembly in accordance with a third preferred embodiment of the present invention, schematically.

The burner assembly in accordance with a third preferred embodiment of the present invention includes a combusting cutoff part in a central part of the burner mat 350 for cutting off surface combustion. The combusting cutoff part includes a cutoff plate 361 in contact with the central part of an upper surface or a lower surface of the burner mat 350.

The cutoff plate 361 prevents the mixed gas flowing in the burner chamber 140 from reaching to a surface of the central part of the burner mat 350, to prevent surface combustion from taking place in the central part of the burner mat 350.

Figure 11A:
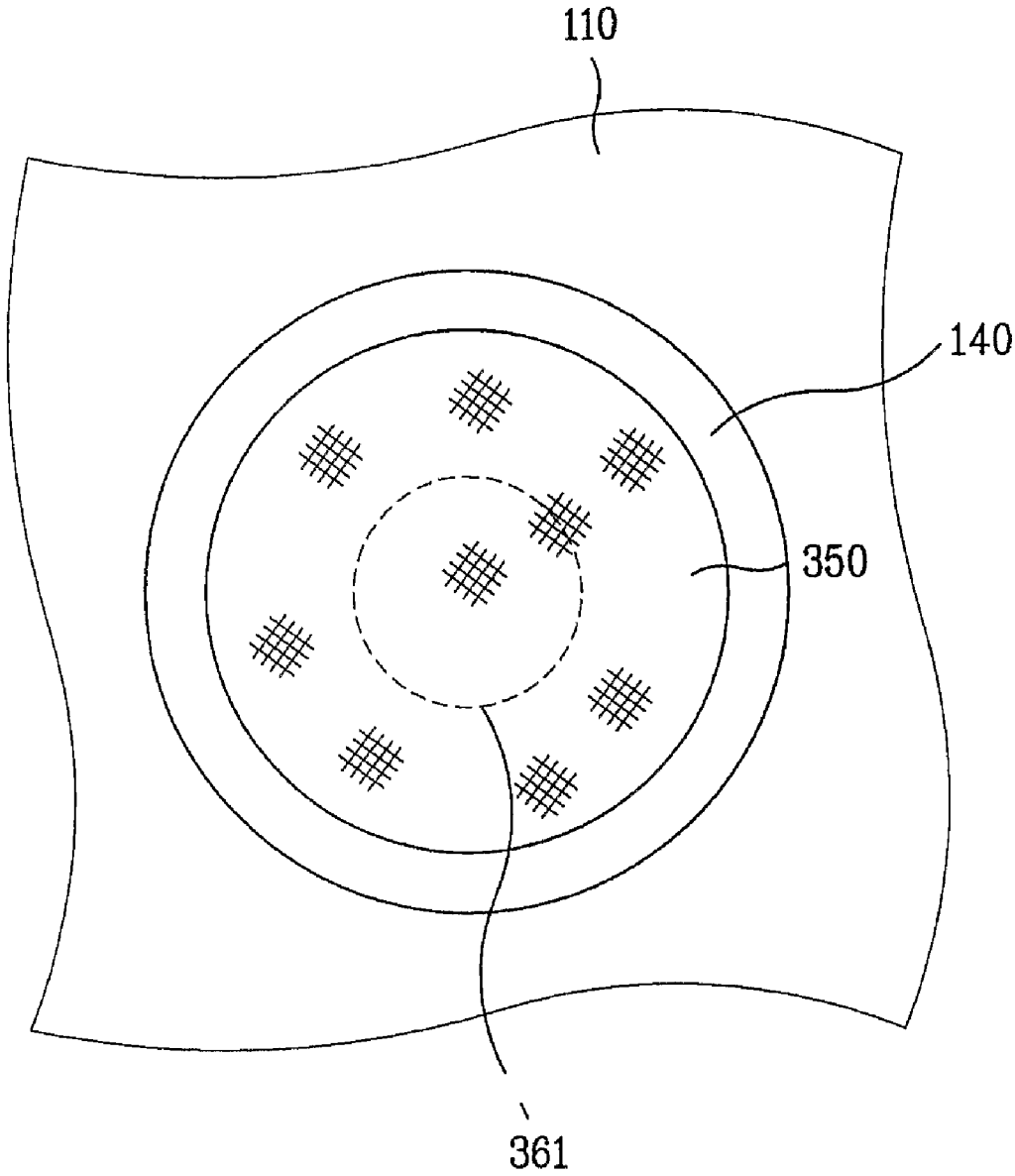
FIGS. 11A and 11B illustrate plan views each showing an example of a form of a cutoff plate, and a fitting state of the cutoff plate to a burner mat in accordance with a third preferred embodiment of the present invention.
Figure 11B:
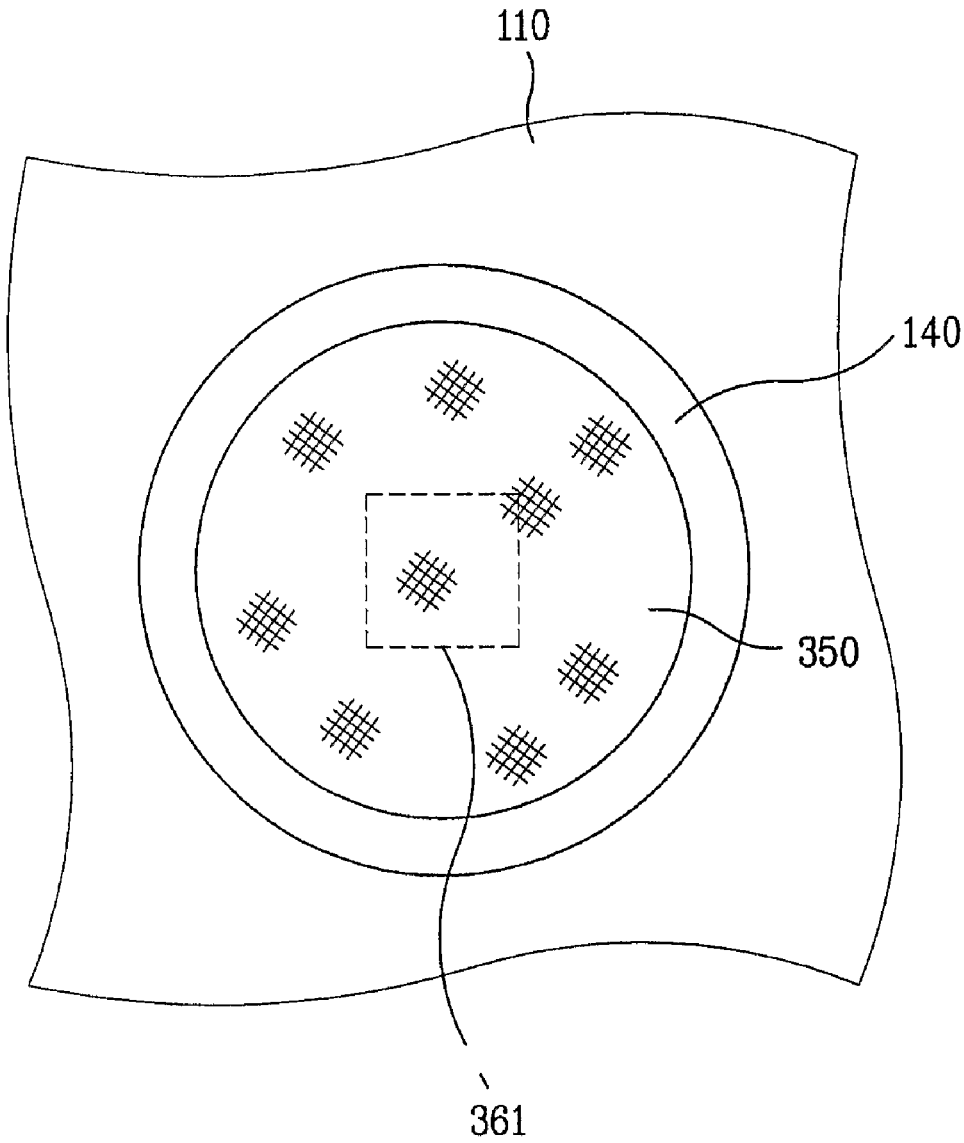

It is preferable that the combusting cutoff part further includes a supporting part 362 for stable supporting of the cutoff plate 361. The cutoff plate 361 may be a disc as shown in FIG. 11A, or polygonal as shown in FIG. 11B when seen in a plan view. Of course, though not shown, the cutoff plate 361 may be of a mesh form.

In a case the cutoff plate 361 has a structure in which the cutoff plate 361 is in close contact with a lower surface of the burner mat 350, the supporting part 362 has one end fixed to an upper surface of an inside of the burner chamber 140, and the other end formed to support a lower surface of the cutoff plate 361. It is preferable that the supporting part is cylindrical, with openings in a circumferential surface thereof for discharging the mixed gas. Particularly, it is more preferable that the circumferential surface of the supporting part 362 is of the mesh form. Of course, though not shown, the supporting part 362 may be in a form of a bar, simply.

The structure of the burner assembly in accordance with a third embodiment of the present invention enables uniform heating of a comparatively large cooking container throughout entire part, as combustion of the mixed gas is made to take place even in the outer side part of the burner mat 350 even with a low flow rate of mixed gas by forming a non-combusting area in a center part of the burner mat 350, and a combusting area in the outer side part of the burner mat 350.

Figure 12:
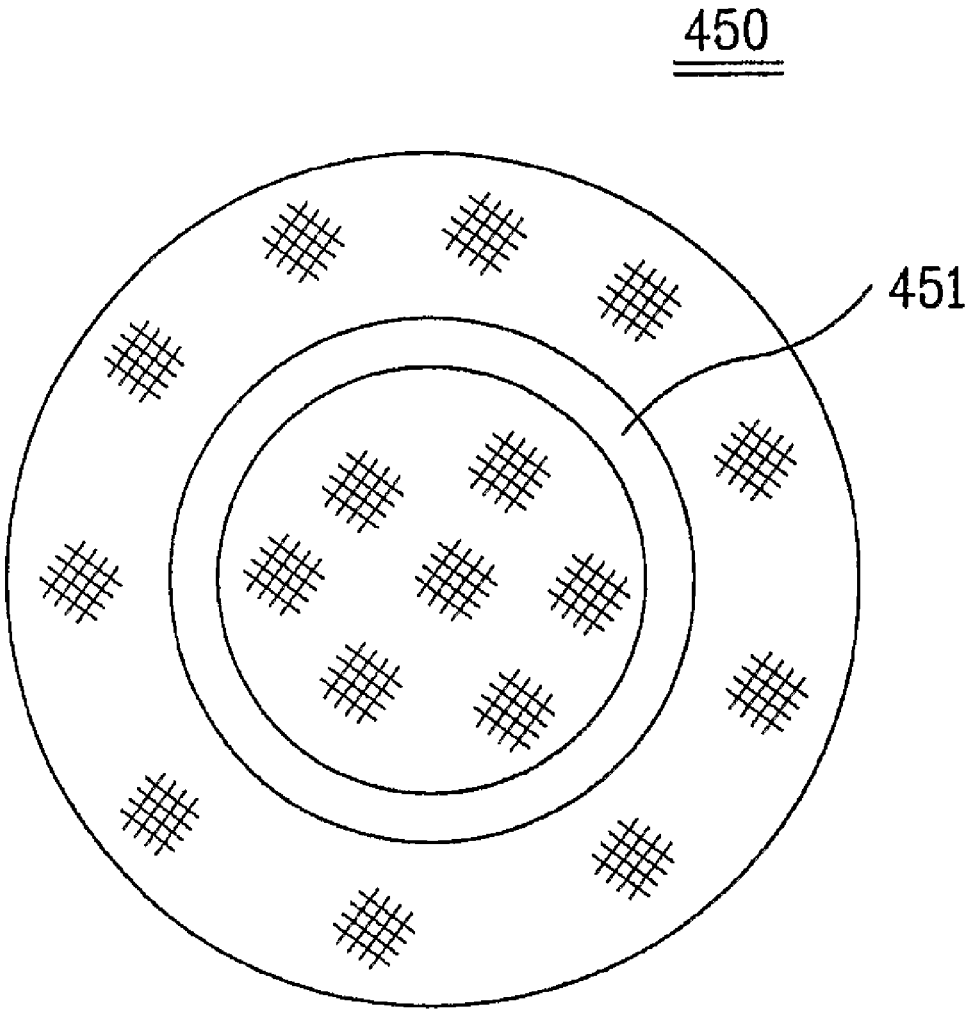
FIG. 12 illustrates a plan view of a burner mat in accordance with a fourth preferred embodiment of the present invention, schematically.

FIG. 12 illustrates a plan view of a burner mat in accordance with a fourth preferred embodiment of the present invention, schematically.

It is suggested that the burner assembly in accordance with a fourth preferred embodiment of the present invention includes a burner mat 450 having a combusting area for combusting a gas, as well as at least one non-combusting area for making no combustion therein.

That is, different from either of the first to third embodiments, the burner mat 450 in accordance with a fourth preferred embodiment of the present invention has no combustion cutoff part separately, but the burner mat 450 itself has the non-combusting area.

For this, the present invention suggests that the non-combusting area of the burner mat is formed of a material different from the combusting area. That is, the non-combusting area of the burner mat 450 is formed of a material 451 that permits no surface combustion.

As shown in the drawing, the non-combusting area of the material may be formed between the center and the outer side of the burner mat 450, or at the center part of the burner mat 450.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The burner assembly of the present invention permits uniform heating of a comparatively large container throughout entire part thereof even at a low temperature, because combustion can take place even at the outer side of the burner mat even if a flow rate of mixed gas is low.

Moreover, the availability of the uniform combustion throughout the entire part of the burner mat resolves the related art problem in which the flame is extinguished easily.

What is claimed is:

1. A burner assembly for a gas burner of radiant heating type, the burner assembly comprising:

a burner chamber that receives a mixed gas;

a burner mat on a top of the burner chamber having a combusting area and at least one non-combusting area; and a combustion cutoff part that forms the at least one non-combusting area of the burner mat, wherein the combustion cutoff part includes a cutoff plate in close contact with the burner mat and a supporting part that supports the cutoff plate to be in close contact with the burner mat, and wherein a plurality of openings is provided in a side surface of the supporting part such that the mixed gas moves through the plurality of openings in the burner chamber.

2. The burner assembly as claimed in claim 1, wherein the combustion cutoff part further includes a structure that forms the at least one non-combusting area between a center and an outer part of the burner mat.

3. The burner assembly as claimed in claim 2, wherein the cutoff plate is in close contact with an upper surface or a lower surface of the burner mat and prevents the mixed gas from reaching a surface of the burner mat and burning.

4. The burner assembly as claimed in claim 3, wherein the cutoff plate has a ring form when seen in a plan view.

5. The burner assembly as claimed in claim 3, wherein when the cutoff plate is in close contact with the lower surface of the burner mat, the supporting part has one end fixed to a bottom surface of an inside of the burner chamber and the other end supports a lower surface of the cutoff plate.

6. The burner assembly as claimed in claim 3, wherein when the cutoff plate is in close contact with the upper surface of the burner mat, the cutoff plate has one end fixed to a bottom surface of an inside of the burner chamber and the other end passes through the burner mat and is connected to the cutoff plate.

7. The burner assembly as claimed in claim 6, wherein the other end of the supporting part is connected to the cutoff plate with a plurality of screws.

8. The burner assembly as claimed in claim 7, further comprising a sealing member between the other end of the supporting part and the cutoff plate that prevents leakage of the mixed gas from the burner chamber.

9. The burner assembly as claimed in claim 3, wherein the supporting part is of a mesh form.

10. The burner assembly as claimed in claim 1, wherein the burner mat includes an inner burner mat and an outer burner mat, each having the combusting area, and wherein a separate part between the respective burner mats has the combustion cutoff part that forms the at least one non-combusting area.

11. The burner assembly as claimed in claim 10, wherein the combustion cutoff part further includes;

the cutoff plate in close contact with a circumference of each of the separated inner and outer burner mats; and the supporting part connected to the cutoff plate having a plurality of seating steps that seats the circumferences of the inner and outer burner mats thereon, respectively.

12. The burner assembly as claimed in claim 1, wherein the combustion cutoff part further includes a structure that forms the at least one non-combusting area at a center part of the burner mat.

13. The burner assembly as claimed in claim 12, wherein the cutoff plate is in close contact with an upper surface or a lower surface of the burner mat and prevents the mixed gas from reaching to a surface of the burner mat, and wherein the supporting part supports the cutoff plate such that the supporting part maintains a state in which the burner mat cutoff plate is in close contact with the burner mat.

14. The burner assembly as claimed in claim 13, wherein when the cutoff plate is in close contact with the lower surface of the burner mat, the supporting part has one end fixed to a bottom surface of an inside of the burner chamber and maintains a state in which the cutoff plate is in close contact with the burner mat, and the other end supports a lower surface of the cutoff plate.

15. The burner assembly as claimed in claim 1, wherein the at least one non-combusting area of the burner mat is formed of a material that permits no surface combustion different from the combusting area.

16. A burner assembly for a gas burner of radiant heating type, the burner assembly comprising:

a burner chamber that receives a mixed gas;

a burner mat on a top of the burner chamber having a combusting area and at least one non-combusting area;

a cutoff plate in close contact with at least one of a lower surface or an upper surface of the burner mat to form the at least one non-combusting area in the burner mat, that prevents the mixed gas from reaching to a surface of the burner mat and burning thereon; and a supporting part that maintains a state in which the cutoff plate is in close contact with the burner mat, wherein a plurality of openings is provided in a side surface of the supporting part such that the mixed gas moves through the plurality of openings in the burner chamber.

17. A burner assembly for a gas burner of radiant heating type, the burner assembly comprising:

a burner chamber that receives a mixed gas; and a burner mat on a top of the burner chamber, the burner mat including;

an inner burner mat and an outer burner mat, each having a respective combusting area; and a separated part between the inner burner mat and the outer burner mat, having a non-combusting area, wherein the separated part between the inner burner mat and the outer burner mat includes:

a cutoff plate in close contact with a circumference of an upper surface of each of the respective burner mats; and a supporting part connected to the cutoff plate having a plurality of seating steps that seats the circumference of each of the respective burner mats, wherein a plurality of openings is provided between the supporting part and a bottom surface of an inside of the burner chamber such that the mixed gas moves through the plurality of openings in the burner chamber.

18. The burner assembly as claimed in claim 17, wherein the separated part between the respective burner mats further includes a connecting member that connects the respective burner mats, and surrounds a part of the connected part of the respective burner mats.

19. A burner assembly for a gas burner of radiant heating type, the burner assembly comprising:

a burner chamber that receives a mixed gas;

a burner mat on a top of the burner chamber having a non-combusting area at a center thereof;

a cutoff plate in close contact with at least one of a lower surface or an upper surface of the burner mat to form the non-combusting area in the burner mat that prevents the mixed gas from reaching to a surface of the burner mat; and a supporting part that maintains a state in which the cutoff plate is in close contact with the burner mat, wherein a plurality of openings is provided in a side surface of the supporting part such that the mixed gas moves through the plurality of openings in the burner chamber.

* * * * *